US005672292A

United States Patent [19]

Villar Otero

[11] Patent Number: 5,672,292

[45] Date of Patent: Sep. 30, 1997

[54] SUPPORT FOR ADDITIONAL DISH IN A MICROWAVE OVEN

[75] Inventor: Domingo Villar Otero, Vigo, Spain

[73] Assignee: Plasticos de Galicia, S.A., Vigo, Spain

[21] Appl. No.: 601,135

[22] Filed: Feb. 14, 1996

[30] Foreign Application Priority Data

Feb. 15, 1995 [ES] Spain ..... 9500433 U

[51] Int. Cl.[6] ..... H05B 6/78

[52] U.S. Cl. ..... 219/754; 219/732; 219/763; 99/DIG. 14

[58] Field of Search ..... 219/732, 733, 219/754, 763; 99/DIG. 14

[56] References Cited

U.S. PATENT DOCUMENTS

| | | | |
|---|---|---|---|
| 4,434,343 | 2/1984 | Bowen et al. | 219/754 |
| 4,455,467 | 6/1984 | Dills | 219/763 |
| 4,542,271 | 9/1985 | Tanonis et al. | 219/730 |
| 4,593,171 | 6/1986 | Colato | 219/754 |
| 4,701,585 | 10/1987 | Stewart | 219/730 |
| 5,223,685 | 6/1993 | DeRienzo, Jr. | 219/763 |

*Primary Examiner*—Philip H. Leung

*Attorney, Agent, or Firm*—Bucknam and Archer

[57] ABSTRACT

The microwave oven has a support located above the rotating circular plate. One food product may be placed on the support and another on the circular rotating plate. The two food products may be heated for different periods of time. A space is provided which permits the easy removal of the food product located on the rotating circular plate without removal of the support.

1 Claim, 1 Drawing Sheet

SUPPORT FOR ADDITIONAL DISH IN A MICROWAVE OVEN

FIELD OF THE INVENTION

The present invention relates to a support for an additional dish in a microwave oven, which is used as a means of support in the interior of a microwave oven for a second dish or other type of recipient, so that the operative capacity of the oven is duplicated with the consequent economy in time and consumption.

The present invention constitutes a very important innovation in the field of small electric home appliances and, in particular, in the field of wares or set of utensils usable with this type of ovens, being susceptible of application at domestic level as well as at industrial level.

BACKGROUND OF THE PRIOR ART

The known microwave ovens incorporate in the interior a rotating circular plate which is used as a support means for a dish or recipient containing the foods to be cooked. After the microwave oven has been connected, the radiant energy emitted by the device impacts on the foods contained in the recipient, causing it to become warm and therefore to be cooked. The ovens further incorporate a timing selector, actionable by the user, which acts on a timer determining the time during which the oven must be maintained in operation, and permits the possibility of carrying out different cooking options provided by the microwave oven.

There are also known some types of supports that after being placed on the internal rotating plate of the microwave oven make possible the simultaneous cooking of two different dishes, one of them disposed on the rotating plate of the oven and the other on the support. However, the prior supports are accompanied by considerable drawbacks which limit their use, since in order to take out the dish located on the rotating plate of the oven it is first necessary to withdraw the support with the dish resting on the same.

SUMMARY OF THE INVENTION

The support for the additional dish in a microwave oven according to the present invention advantageously overcomes the problems outlined above by providing means allowing the independent access to the dish located on the rotating plate of the oven as well as to the dish directly placed on the above mentioned support, with absolute comfort, without being necessary at any time to withdraw the support in order to take out one or the other dish. Therefore, the operative oven capacity is duplicated and further another very important advantage is achieved consisting of the possibility of simultaneously cooking two foods needing different times, for which, once the shorter cooking time has elapsed the corresponding dish can be withdrawn and thereinafter continuing with cooking the foods contained in the other dish, during the necessary additional time, and without any need of withdrawing the support of the present invention.

The support which will be described below is constituted of a circular base limited by an external perimetrical flat strip of little width, which is continued toward the interior with a recess shaped with a semicircular profile forming a circumferential slot, following which there is the supporting base of a height that is slightly lower than the height of the said external perimetrical strip. Sideways, the support has four projections or walls in a two-by-two diametrically opposite positions, which are usuable as supporting foots and the development of which is slightly divergent downwardly, being provided with a lower external rib for the reinforcement of the same. These downward projections or walls are provided with wide notches in their remote edges.

With this configuration, a dish or recipient containing those foods to be cooked is placed on the supporting base, while directly located on the rotating circular base of the microwave oven another dish containing other foods can be placed, for simultaneous cooking, the last one remaining housed within the space defined under the supporting base and among the four side projections or supporting foots mentioned hereinabove, a fact which clearly duplicates the operative capacity of the microwave oven. The dish which is directly placed on the oven plate can thus be taken out, or alternatively may be introduced in the space existing under the base, thanks to the notches performed in the support side walls, without withdrawing the support, these operations being possible from both diametrically opposite sides.

BRIEF DESCRIPTION OF THE DRAWINGS

In the drawings accompanying the present description it has been represented, by way of example and therefore without any limitative character, a preferred embodiment of the object of the present invention. In such drawings.

DESCRIPTION OF THE PREFERRED EMBODIMENT OF THE INVENTION

Figure 1:
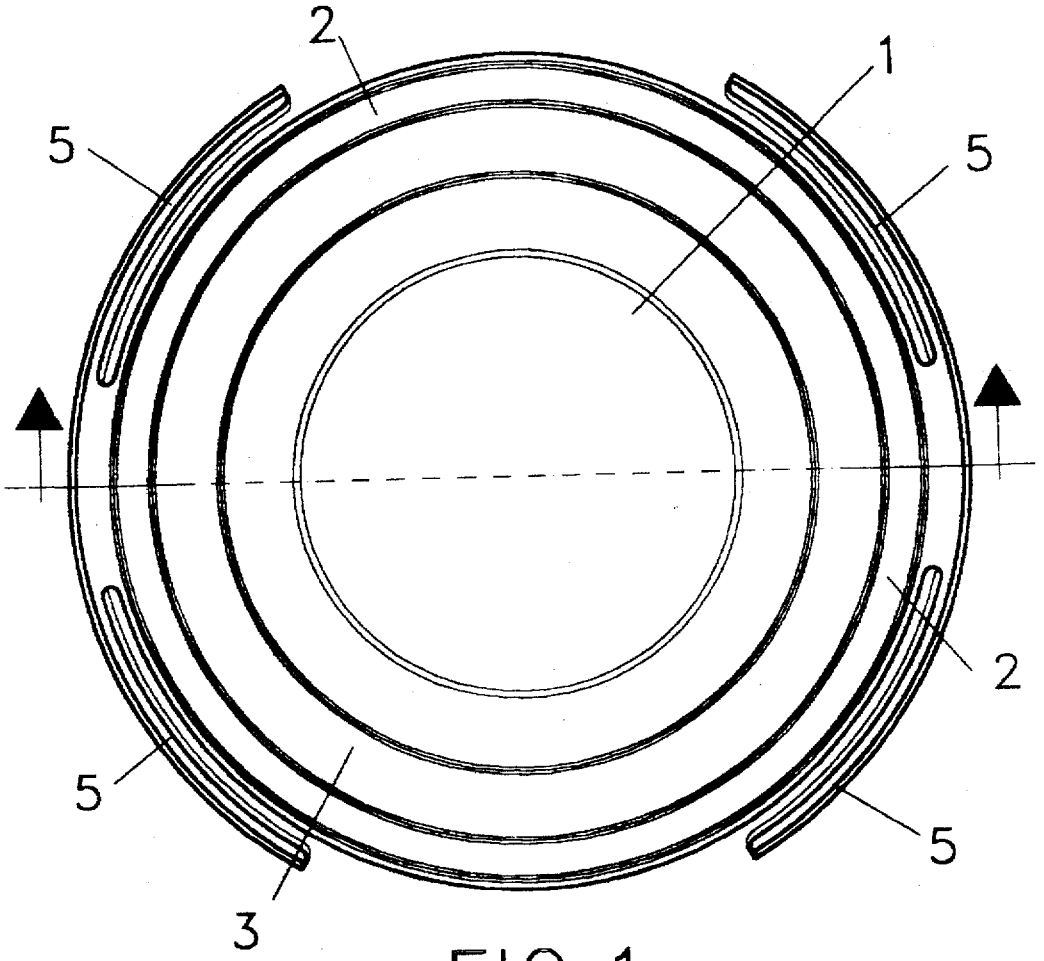
FIG. 1 shows a plan view of the support for additional dish in microwave ovens according to the present invention.

According to the illustration of the support of the invention appearing in both figures, it can be observed that said support consists of a circular base (1), delimited by a flat perimetrical external strip (2) which is located at a height slightly greater than the height of the base (1). In joining both the base (1) and the perimetrical strip (2), the surface of the base descends to form a circumferential slot (3) having a semicircular profile. At both sides and in a downward direction there are four projections or walls (5), with a predetermined height, in two-by-two diametrically opposite positions, which are slightly inclined toward the outside as can be appreciated by the cross-section A-B in FIG. 1, that is to say, downwardly diverging, in which wide notches (7) have been made, and fitted with lower external ribs (6) to reinforce the same. These projections (5) have the double task of serving as supporting foots for the support of the present invention and, at the same time, serving as separating elements of the base (1) with respect to a dish that eventually is located directly supported by the rotating plate of the oven and which will remain housed in the space (4) located under the base (1) and between the projections (5).

The dish or recipient for containing foods that is placed on the support of the present invention, will lie directly on the base (1), such that the perimetrical strip (2) positioned at a greater height than the height of the base (1) will serve as a retention means against any undesired sliding of the mentioned dish.

Figure 2:
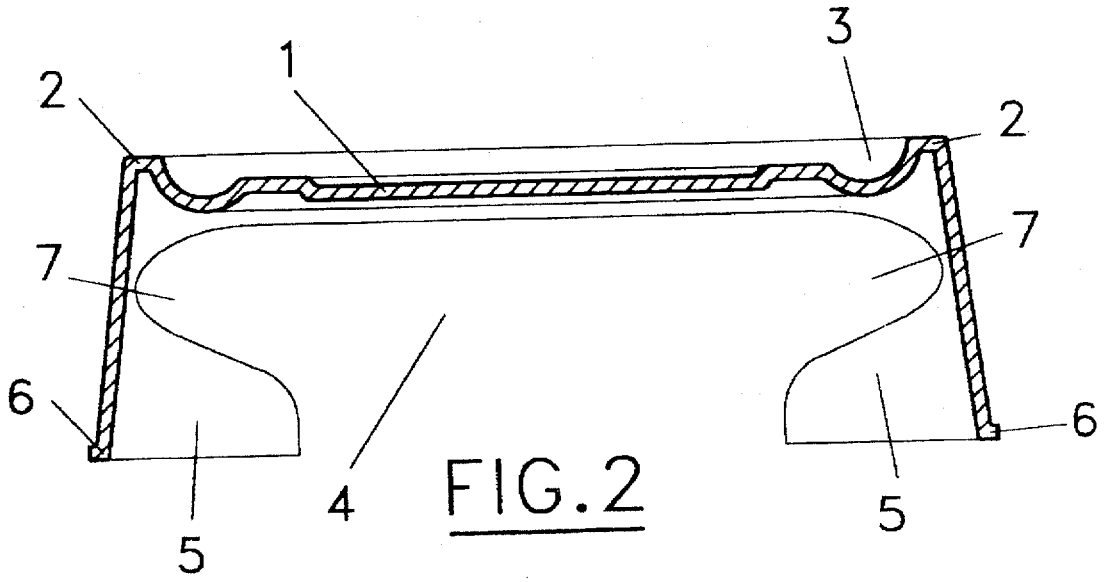
FIG. 2 represents an elevational side view of the invention according to a cross-section taken along the line A-B in FIG. 1.

As can be readily understood from drawings, specially from FIG. 2, taking out a dish located on the plate of the microwave oven once the preparation of the foods contained in said dish has ended, does not present any inconvenience, because the notches (7) in the projections (5) allow the edges of the dish to be withdrawn, without any inconvenience.

Evidently, the reverse operation, that is to say, the introduction of a new dish in substitution of that one which has been withdrawn, is equally simple and quick.

As it may be clear to anyone skilled in the art, the support of the present invention permits to cook simultaneously two dishes with different foods even if each food needs a different cooking time. In effect, by programming the oven for the shortest cooking time, once this time is elapsed, the dish whose preparation is ended can be withdrawn, the oven being programmed again for the time required to end the preparation of the foods of the second dish, and even as an alternating possibility, once the first dish has been withdrawn a new dish could be introduced to replace that one withdrawn, with other foods, for its simultaneous preparation during the remainder of the time to finish the preparation of the food contained in the second dish.

Other features and advantages provided by the present invention will become evident to anyone skilled in this art. By way of example, it can be mentioned the ease for cleaning the support of the invention by virtue of its configuration, as well as the ease of storage.

It is to be understood that the invention will be subject to variations in the size or material used for its manufacture, without this fact involving any alteration in the scope of the invention.

I claim:

1. A microwave oven for cooking two foods simultaneously, comprising a rotating circular plate, a support (1) located above said rotating circular plate, said support (1) having a circular base, a perimetrical external strip (2) located above said circular base, said external strip forming a slot (3) with semicircular profile, said support having lateral walls, said lateral walls having four downwardly extending projections (5), said four projections forming two pairs of projections, the projections of each pair being diametrically opposite to the projections of another pair, said projections being diametrically arranged and diverging downwardly, said projections having ribs (6) at the lower end thereof, said projections having notches (7), said support (1) having an inner surface, said inner surface and said projections defining a space (4), one food being placed on said rotating plate and another food being located on said support, the food being located on said rotating circular plate being easily removed from said space.

* * * * *